US005251887A

United States Patent [19]

Arnold et al.

[11] Patent Number: 5,251,887

[45] Date of Patent: Oct. 12, 1993

[54] MACHINE VISE FOR CLAMPING A WORKPIECE

[75] Inventors: Franz Arnold, Spatzenweg 20, D-8960 Kempten; Konrad Kreuzer, Dietmannsried, both of Fed. Rep. of Germany

[73] Assignee: Franz Arnold, Kempten, Fed. Rep. of Germany

[21] Appl. No.: 704,557

[22] Filed: May 23, 1991

[30] Foreign Application Priority Data

Jun. 7, 1990 [DE] Fed. Rep. of Germany ..... 4018194
Apr. 16, 1991 [DE] Fed. Rep. of Germany ..... 4112418

[51] Int. Cl.[5] ..... B25B 1/06

[52] U.S. Cl. ..... 269/221; 269/136; 269/240

[58] Field of Search ..... 269/136, 221, 224, 240, 269/244, 245, 246

[56] References Cited

U.S. PATENT DOCUMENTS

| | | | |
|---|---|---|---|
| 3,416,784 | 9/1965 | Wermuth et al. | 269/136 |
| 3,650,522 | 3/1972 | Wermuth et al. | 269/221 |
| 3,902,707 | 9/1975 | Preisenhammer | 269/221 |
| 4,043,547 | 8/1977 | Glomb et al. | 269/136 |
| 4,098,500 | 7/1978 | Lenz | 269/136 |
| 4,669,712 | 6/1987 | Krause | 269/32 |
| 4,899,999 | 2/1990 | Arnold | 269/240 |
| 4,932,643 | 6/1990 | Röhm | 269/244 |

FOREIGN PATENT DOCUMENTS

| | | |
|---|---|---|
| 34337303 | 11/1984 | Fed. Rep. of Germany . |
| 3437403 | 12/1984 | Fed. Rep. of Germany . |
| 3733849 | 7/1987 | Fed. Rep. of Germany . |

*Primary Examiner*—Bruce M. Kisliuk
*Assistant Examiner*—Eileen Morgan
*Attorney, Agent, or Firm*—Lowe, Price, LeBlanc & Becker

[57] ABSTRACT

A machine vise is provided with a body having a fixed jaw and a movable jaw which may be moved toward the fixed jaw by means of a tractively acting hollow screw spindle. A force amplifier is arranged below the fixed jaw and is operable by a pushing rod shiftably inserted in the hollow screw spindle. A common driving device rotates the screw spindle into and away from its clamping position. Upon a predetermined clamping force being exceeded the force amplifier is activated by the pushing rod. The movable jaw may be split in upper and lower portions.

7 Claims, 12 Drawing Sheets

MACHINE VISE FOR CLAMPING A WORKPIECE

FIELD OF THE INVENTION

The invention relates to a machine vise for clamping a workpiece, and in particular to a machine-tool vise having a force amplifier incorporated therein.

BACKGROUND OF THE INVENTION

German Patent No. 37 33 849 discloses a machine vise using a force amplifier exerting in clamping position a high pressure onto the spindle nut provided at the movable jaw resulting in a corresponding reaction force in the fixed jaw This may cause a bending of the body such that the opposing clamping surfaces of the fixed and movable jaws are no more parallel to each other, a situation considerably reducing the capability of fully clamping the workpiece.

German Patent No. 34 37 403 discloses a machine-tool vise comprising a force amplifier arranged below the movable jaw in a fully retracted position of the latter. A common drive means for the movable jaw and the force amplifier is attached to the machine vise projecting considerably from the body thereof. Final clamping by activating the force amplifier exerts a high pressure onto the screw spindle supported in the body causing a bending thereof resulting in a loss of the parallelity of the opposing clamping surfaces of the fixed and movable jaws. A similar machine vise is disclosed in U.S. Pat. No. 4,899,999.

U.S. Pat. No. 4,098,500 discloses a machine vise without force amplifier having the movable jaw split into an upper part and a lower part the lower part having formed thereon the spindle nut and an insert portion loosely received in a recess of the upper part. The insert portion and the recess have opposing surfaces inclined at an angle of about 45° in respect of the screw spindle axis. By means of a screw the opposing inclined surfaces of the insert portion and the recess are fixedly urged against each other. A vertical screw fixes the position between the upper and lower parts. Thus, there is no resiliency between them resulting in a considerable friction during movement of the movable jaw.

U.S. Pat. No. 4,043,547 discloses a machine vise without force amplifier, similar to that of the machine vise just described, with the additional feature of having a spring washer arranged between said opposing inclined surfaces.

SUMMARY OF THE INVENTION

It is the object of the invention to provide a machine vise offering exact parallel clamping of a workpiece.

It is a further object of the invention to provide a machine vise having a large ratio between overall length of the machine vise and the maximum clamping width.

These and other objects of the invention are solved by a machine vise comprising an elongated body having a lengthwise extending recess of generally U-shaped cross section; a fixed jaw provided at one end of said body; a movable jaw arranged for sliding on guiding surfaces in an axial direction along said body toward said fixed jaw and having formed thereon a projection extending into said recess and having a nut formed therein; moving means for said movable jaw arranged in said recess and extending in said axial direction thereof and including a hollow screw spindle engaging said nut and having arranged therein a pushing rod; a force amplifier means arranged in said body below said fixed jaw and operable by said pushing rod; driving means common to said screw spindle and said force amplifier means and acting against an end of said pushing rod opposite to said force amplifier for first moving said movable jaw into a preliminary clamping position by rotating said screw spindle and then activating said force amplifier means upon exceeding a predetermined clamping force said driving means being arranged within said body below said movable jaw when in a fully retracted position; and tractively acting connecting means arranged slidably in said axial direction between an end of said screw spindle adjacent to said force amplifier and an end of said force amplifier opposite to said pushing rod.

According to another aspect of the invention a machine vise is comprising an elongated body having a lengthwise extending recess of generally U-shaped cross section, a fixed jaw provided at one end of said body, a movable jaw arranged for sliding on guiding surfaces in an axial direction along said body toward said fixed jaw and having formed thereon a projection extending into said recess and having a nut formed therein, moving means for moving said movable jaw arranged in said recess and extending axially therein including a screw spindle engaging said nut; a force amplifier means arranged in said body a driving means common to said screw spindle and said force amplifier means for first moving said movable jaw into a preliminary clamping position by rotating said screw spindle and then activating said force amplifier means upon exceeding a predetermined clamping force said driving means being essentially arranged within said body; and wherein said movable jaw is divided into a slide-type lower part provided with said projection having said nut and an insert portion and an upper part provided with a recess for loosely receiving said insert portion said recess having an inclined surface at a side closer to a clamping position for said workpiece inclined at an angle between 55° and 80° in respect of an axis of said screw spindle said insert portion having a surface complementary opposing said inclined surface and said body being provided with upper and lower axially extending guiding means for guiding said lower part essentially over its overall length.

DETAILED DESCRIPTION OF THE PREFERRED EMBODIMENTS

Figure 1:
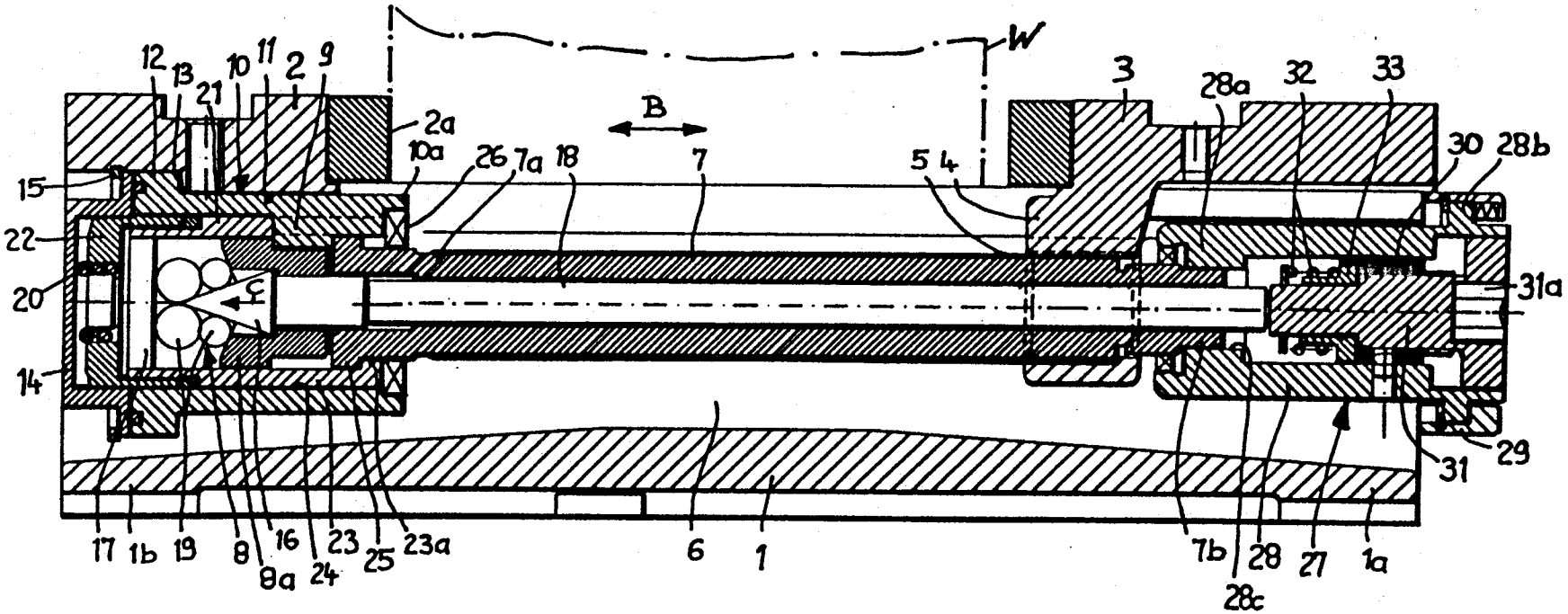
FIG. 1 is a longitudinal section of a machine vise of a first embodiment using a mechanical force amplifier.

Referring to FIGS. 1 to 4 a machine vise 100 of the first embodiment of the invention comprises an elongated body 1 of essentially U-form cross section. A stationary jaw 2 is formed at one end of body 1 preferably integral therewith A movable jaw 3 is arranged in body 1 shiftable in a direction B toward or away, respectively, from stationary jaw 2. Movable jaw 3 is provided with a projection 4 directed downward into body 1 and having threaded therein a spindle nut 5. A screw spindle 7 is mounted in a longitudinal through-passage 6 of body 1 engaging spindle nut 5.

Figure 5:
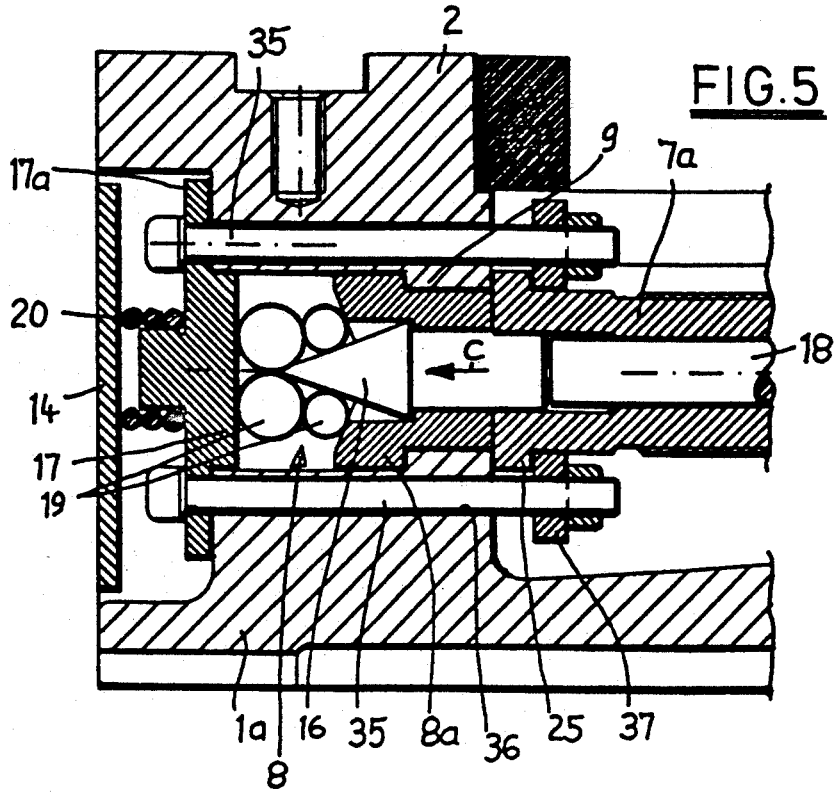
FIG. 5 is a sectional view similar to that of FIG. 2 of a second embodiment of the machine vise of the invention showing the mechanical force amplifier arranged below a stationary jaw.

A mechanical force amplifier 8 of known design, e.g. as disclosed in (U.S. Pat. No. 4,899,999) is arranged in body 1 below stationary jaw 2. An engaging element 8*a* of force amplifier 8 supports at an abutment member 9 arranged between force amplifier 8 and end 7*a* of screw spindle 7 adjacent to stationary jaw 2. As illustrated in FIG. 5, abutment member 9 may be integrally formed with body 1. However, preferably abutment member 9 is formed as an abutment member sleeve 10 inserted into a corresponding cylindrical passage 11 in body 1. Abutment member sleeve 10 is provided with a flange 12 at its one end distant from screw spindle 7, flange 12 engaging an annular stop 13 of body 1 contiguous to one end of passage 11. End 10*a* of abutment member sleeve 10 adjacent to screw spindle 7 extends at least up to end 2*a* of stationary jaw 2 facing the screw spindle 7. Preferably abutment member sleeve 10 is closed at its end distant from screw spindle 7 by a cover 14. Cover 14 and abutment member sleeve 10 are mounted in passage 11 by a spring ring 15.

Figure 2:
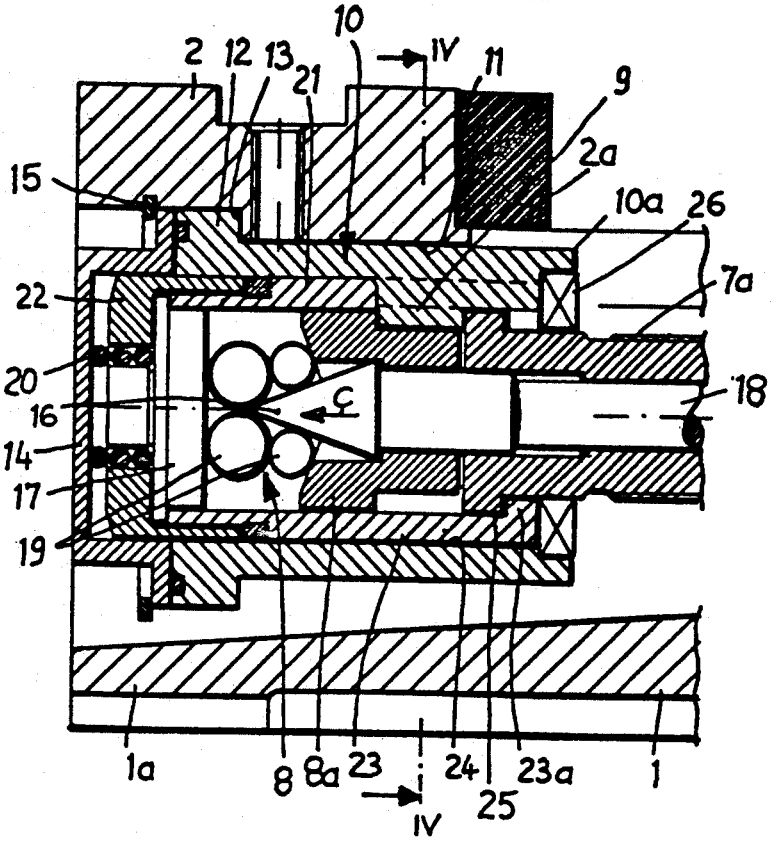
FIG. 2 is a more detailed sectional view of a portion of the machine vise of FIG. 1 housing the force amplifier.

As best seen in FIG. 2, force amplifier 8 includes a wedge-type primary member and a disk-type secondary member 17. When moving primary member 16 by means of a pushing rod 18 housed within the hollow screw spindle 7 in a direction C, in FIG. 1 to the left rolls 19 are pressed into a space which narrows a radially outward direction. This causes the secondary member 17 to be moved to the left as well with a corresponding force transmission ratio, however by a smaller distance than primary member 16. In order to maintain elements 16, 17, and 19 of force amplifier 8 in permanent engagement and to retreat them into their home positions, there is provided a compression spring 20, preferably between cover 14 and secondary member 17.

A pulling sleeve 21 provided concentrically within abutment member sleeve 10 and axially shiftable therein surrounds force amplifier 8. Pulling sleeve 21 is closed at its one end by a threaded cover 22 supporting at its inner side secondary member 17. At its other end pulling sleeve 21 has formed thereon three axially directed peripheral key-type projections 23 (see in particular FIG. 4) arranged at equal peripheral angular distances. These projections 23 extend through corresponding axial recesses 24 in abutment member sleeve 10 to end 7*a* of screw spindle 7 adjacent to stationary jaw 2. Projections 23 are provided at their ends with hooks 23*a* directed radially inward and engaging a flange 25 provided at end 7*a* of screw spindle 7. A sealing 26 may seal the interior of abutment member sleeve 10 against end 7*a* of screw spindle 7.

Figure 3:
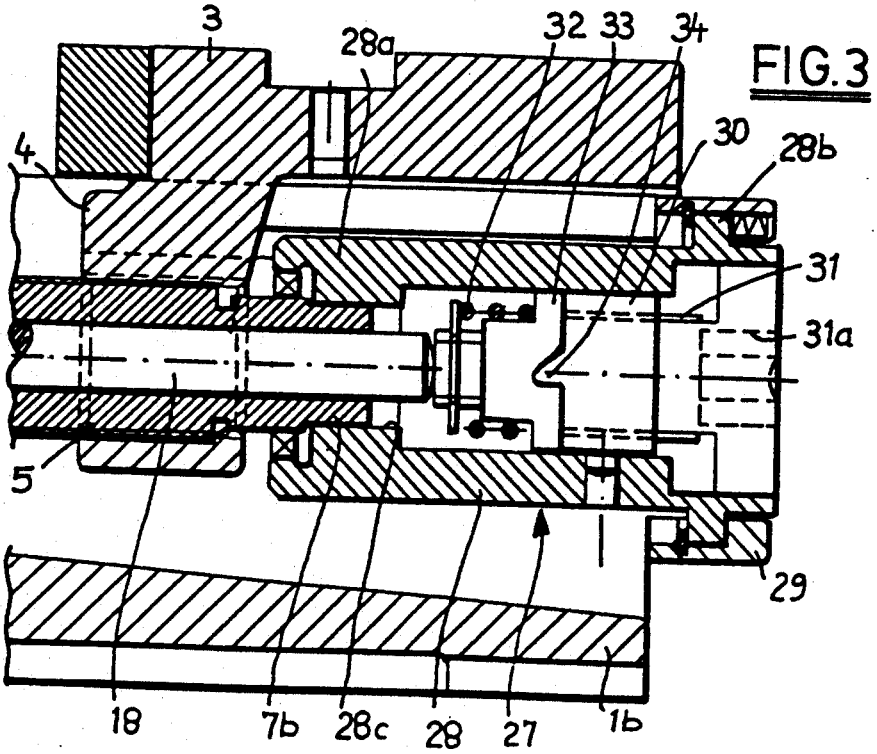
FIG. 3 is a more detailed sectional view of the machine vise of FIG. 1 showing a movable jaw and a driving device.
Figure 4:
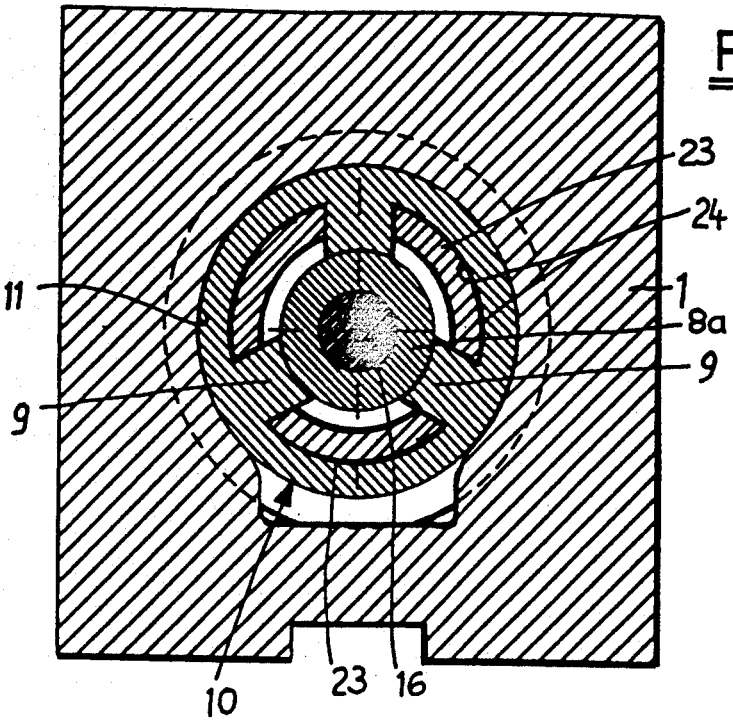
FIG. 4 is a cross sectional view along the line IV—IV of FIG. 2.

Furthermore, as best seen in FIGS. 1 and 3, there is provided a common driving device 27 driving in time sequence both screw spindle 7 and force amplifier 8. Driving device 27 is arranged within end 1*a* of body 1 opposite stationary jaw 2 such that it is arranged wholly or at least essentially within body 1 with movable jaw 3 in its fully opened position located above driving device 27 as illustrated in FIG. 1. Driving device 27 is enclosed by a cylindrical housing 28 one end of which faces screw spindle 7 and is connected to screw spindle 7 and is positively fixed against rotation but axially shiftable. This positive connection may, for example, comprise an opening 28*c* having a hexagonal cross section and provided at one end 28*a* of housing 28 and surrounding end 7*b* of screw spindle 7 formed matingly hexagonal. The other end 28*b* of housing 28 is supported so as to be rotatable and axially non-shiftable in a fixing plate 29 connected to body 1. Driving device 27 further comprises a threaded sleeve 30 fixedly connected to housing 28. Threaded sleeve 30 engages a driving spindle 31 whose exterior end is provided with an inner hexagonal recess 31*a*, arranged to have inserted thereto a hand crank (not shown). Furthermore, between threaded sleeve 30 and driving spindle 31 there is arranged a torque coupling comprising with the illustrated embodiment a coupling disk 33 connected to driving spindle 31 fixed against rotation but shiftable thereon against the force of a spring 32, coupling disk 33 engaging by means of a cam 34 a recess of threaded sleeve 30. By means of torque coupling 32 to 34, driving spindle 31 and threaded sleeve 30 are connected with each other secured against rotation upon exceeding of a predetermined torque.

For outside clamping of a workpiece W the latter is placed on body 1 between the jaws 2 and 3. By means of a hand crank (not shown) driving spindle 31 may be rotated, taking along through torque coupling 32 to 34 threaded sleeve 30 and cylindrical housing 28 connected thereto secured against rotation. Rotation of housing 28 causes screw spindle 7 to be rotated through the positive connection 7*b*/28*c*. Thus movable jaw 3 is moved toward workpiece W by means of spindle nut 5, in FIG. 1 to the left, until movable jaw 3 engages workpiece W. The clamping pressure now increases coupling 32 and 34 slips and screw spindle 7 is not rotated by it anymore.

Furthermore rotation of driving spindle 31 causes the latter to be screwed into the now resting threaded sleeve 30, in FIG. 1 to the left, urging against pushing rod 18 which in turn urges against primary member 16 moving the latter in direction C (FIG. 1). This results in a movement of secondary member 17 in direction C as well by a smaller distance than the primary member 16, however with a higher force. A compression force generated by secondary member 17 and directed radially outward is transmitted to pulling sleeve 21 and its key-type projections 23. As best seen in FIGS. 2 and 3, this results in a tractive or pulling force, acting mid hooks 23*a*, flange 25 of screw spindle 7. Thus, movable jaw 3 is pulled against workpiece W with a high force fixedly clamping it. During clamping, abutment member sleeve 10 is loaded in a tractive or pulling direction and with its flange 12 supports jaw 12 and applies a force thereto mid annular stop 13 of body 1. Transmission of force is thus accomplished between abutment member sleeve 10 and body 1 without overloading any possibly elastic connecting elements.

The modification according to FIG. 5 illustrates an alternative form for the pulling or tracting connection between secondary element 17 and end 7*a* of screw spindle 7 circumventing force, amplifier 8 outside and passed through abutment member 9. The driving side of this embodiment is the same as that illustrated in FIGS. 1 and 3 for the first embodiment. Elements having similar functions are designated with similar reference numerals and are no more explained in detail. With the embodiment of FIG. 5 the tractive connection comprises at least two axially directed pulling or tracting bolts 35 extending through axially directed bores 36 of abutment member 9 or body 1, respectively. Bolts 35 are connected at their one ends to a disk 17*a* supporting secondary member 17 and at their other ends with a ring 37 surrounding end 7*a* of screw spindle 7. A ring 37 abuts behind flange 25 provided at end 7*a* of screw spindle 7. Upon movement of primary element 16 by pushing rod 18 in direction C, in FIG. 1 to the left, the compression force generated at the secondary element 17, amplified thereby and directed in FIG. 5 to the left, is translated by means of bolts 35 in a tractive or pulling force acting onto screw spindle 7.

Figure 6:
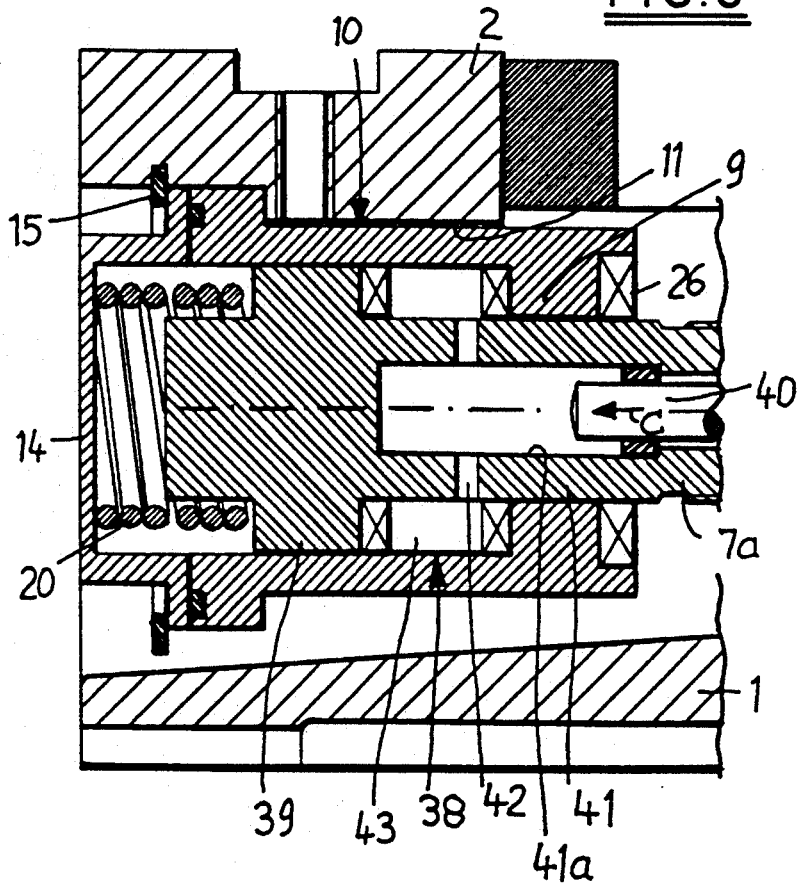
FIG. 6 is a sectional view similar to that of FIG. 5 of a third embodiment of a machine vise using a hydraulic force amplifier.
Figure 7:
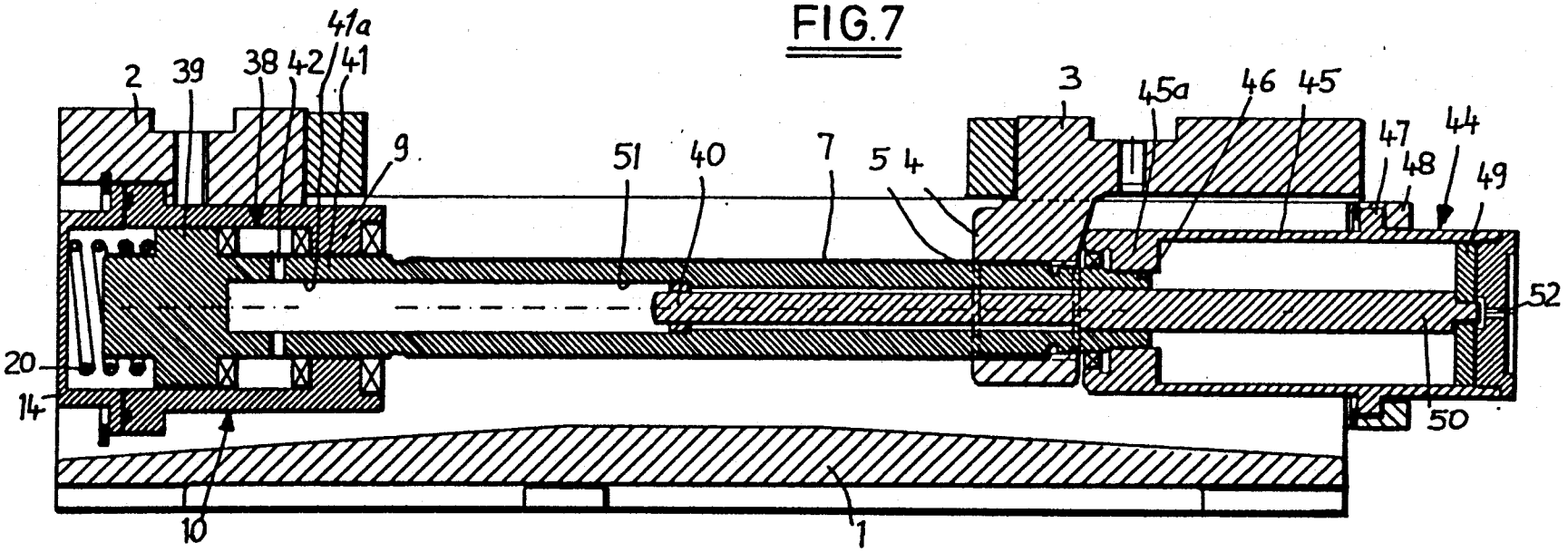
FIG. 7 is an overall longitudinal sectional view of a fourth embodiment of a machine vise of the invention using a pneumatically operated driving device.

The embodiments according to FIGS. 6 and 7 use a hydraulic force amplifier 38. Again, elements of similar functions are designated with similar reference numerals as with the embodiments explained above. Again, hydraulic force amplifier 38 is mounted in body 1 below stationary jaw 2. As with the embodiment according to FIGS. 1 and 2, abutment member 9 is (preferably integrally) provided in an abutment member sleeve 10 inserted in a passage 11 of body 1. A secondary piston 39 of force amplifier 38 is shiftably mounted in abutment member sleeve 10. The free end of pushing rod 18 is formed as a primary piston 40 or acts against a separate primary piston 40. Between secondary piston 39 and end 7*a* of screw spindle 7 adjacent to stationary jaw 2 there is provided a hollow connecting element 41 concentrically surrounding primary piston 40 and fixedly connecting secondary piston 39 to end 7*a* in tractive direction. An interior space 41*a* of connecting element 41 is filled with hydraulic fluid and is connected by radial bores 42 with a surrounding cylindrical space 43 of secondary piston 39. Upon movement of primary piston 40 in direction C, in FIG. 7 to the left, hydraulic liquid is removed from interior space 41*a* into cylindrical space 43 resulting in a shifting of the secondary piston 39 in FIG. 7 to the left. Since secondary piston 39 has an essentially larger effective surface than primary piston 40, this results in a force transmission. The force caused by secondary piston 39 in a direction to the left will be transmitted through the hollow connecting element 41 to screw spindle 7 resulting in an application of a high tractive force at the latter.

Screw spindle 7 and pushing rod 18 acting against the primary piston 40 may be driven by a common driving device 27 as with the embodiment according to FIGS. 1 to 3. Alternatively, the design of the machine vise of the invention enables a particularly simple and room-saving arrangement of a partially pneumatically operating driving device as illustrated in FIG. 7. This driving device 44 comprises a pneumatic cylinder 45 whose end 45*a* facing the screw spindle 7 is connected in a similar manner as cylindrical housing 28 by a positive connection 46 secured against rotation but axially shiftable with screw spindle 7. Pneumatic cylinder 45 is further provided on its exterior with an annular projection 47 supported rotatably but not axially shiftable in a support plate 48 connected to body 1.

A piston 49 having a plunger 50 is shiftably arranged in pneumatic cylinder 45. Plunger 50 constitutes the pushing rod and its free end forms primary piston 40. A larger portion of hollow screw spindle 7 forms a confined cylinder space 51 filled with hydraulic fluid and having the primary piston 40 shiftable therein. As with the preceding embodiment shifting of primary piston 40 to the left presses hydraulic fluid through radial bores 42 into cylindrical space 43 of secondary piston 39. With the embodiment of FIG. 7 by manually rotating pneumatic cylinder 45 movable jaw 3 may first be moved toward the workpiece by turning screw spindle 7 until movable jaw 3 engages workpiece W with a small force. Actual clamping of workpiece W is accomplished by high pressure by introducing pressurized air through bore 52 into pneumatic cylinder 45 resulting in a shifting of piston 49 to the left. For subsequent clamping of workpieces of similar sizes movable jaw 3 is adjusted by rotating pneumatic cylinder 45 such that there is some loose between workpiece and movable jaw 3 sufficient for inserting workpieces between jaws 2 and 3 in an unclamped position of piston 49.

Figure 8:
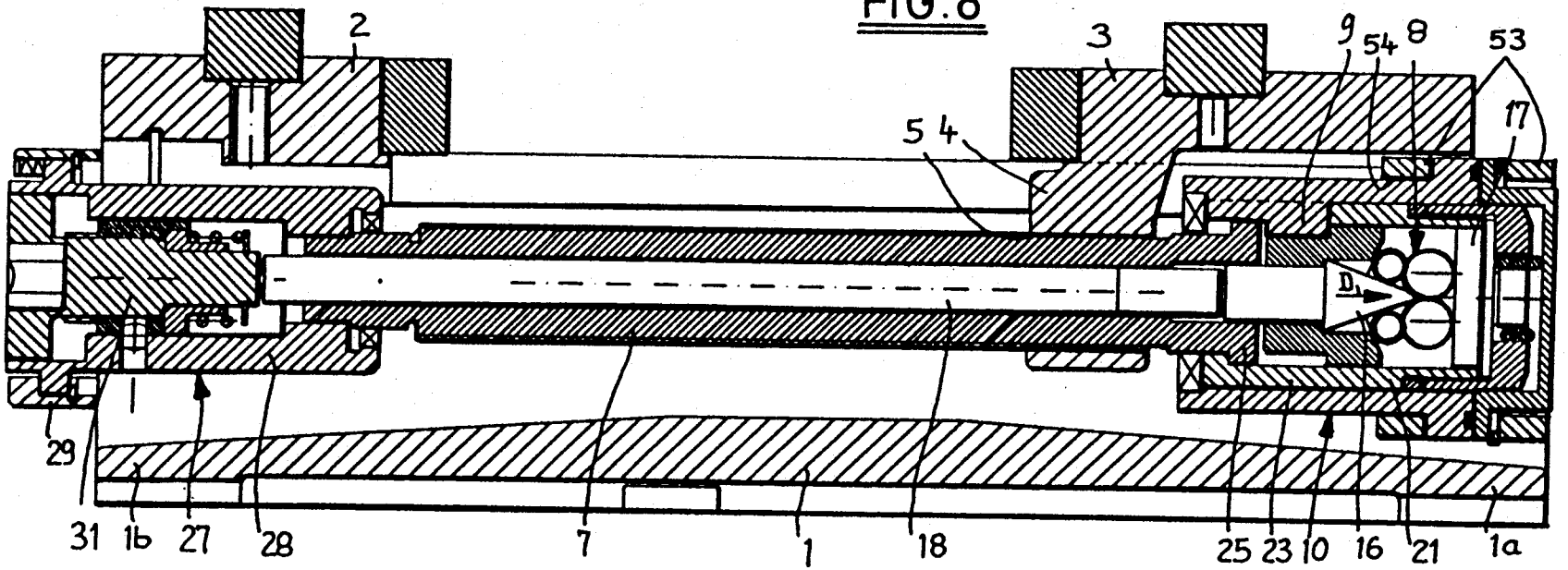
FIG. 8 is a longitudinal sectional view of the first embodiment according to FIG. 1 modified for use for inside clamping of workpieces.

It should be noted that a machine vise according to the embodiments of FIGS. 1 to 7 may be easiliy modified for using the vise for inside clamping of workpieces. This is explained hereinafter referring to FIG. 8. Abutment member sleeve 10 arranged below stationary jaw 2 will be removed from its passage 11 and is inserted into an appropriate support 53 provided at end 1*a* of body 1 opposite stationary jaw 2. Screw spindle 7 is turned by 180° and screwed in this position into spindle nut 5. Cylindrical housing 28 together with driving device 27 is mounted below stationary jaw 2 and support plate 29 is inserted at end 1*b* of body 1 below stationary jaw 2. Upon rotation of driving spindle 31 first screw spindle 7 is rotated and movable jaw 3 is shifted, in FIG. 8 to the right, until the two jaws 2 and 3 engage inner surfaces of a workpiece. Then, torque coupling 32 to 34 (FIG. 3) disengages and upon further rotation of driving spindle 31 pushing rod 18 shifts primary element 16 in a direction D, in FIG. 8 to the left. Then, secondary member 17 pulls movable jaw 3 with high tractive force against the inner surfaces of the workpiece via pulling sleeve 21. Support 53 is an additional abutment inserted into end 1*a* of body 1 when using the machine vise for inside clamping. Support 53 is provided with a passage 54 for receiving abutment member sleeve 10.

Figure 9:
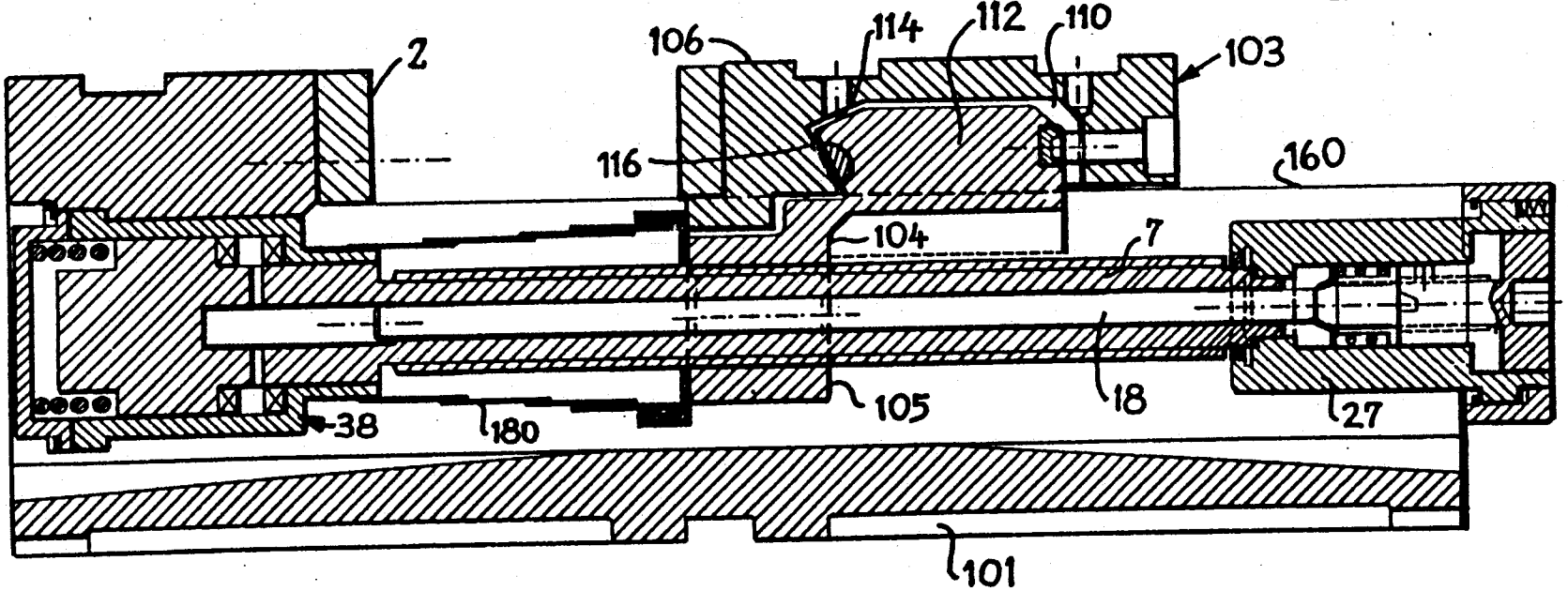
FIGS. 9 and 10 are longitudinal sectional views of a fifth embodiment of a machine vise according to the invention in clamping position and open position, respectively.
Figure 10:
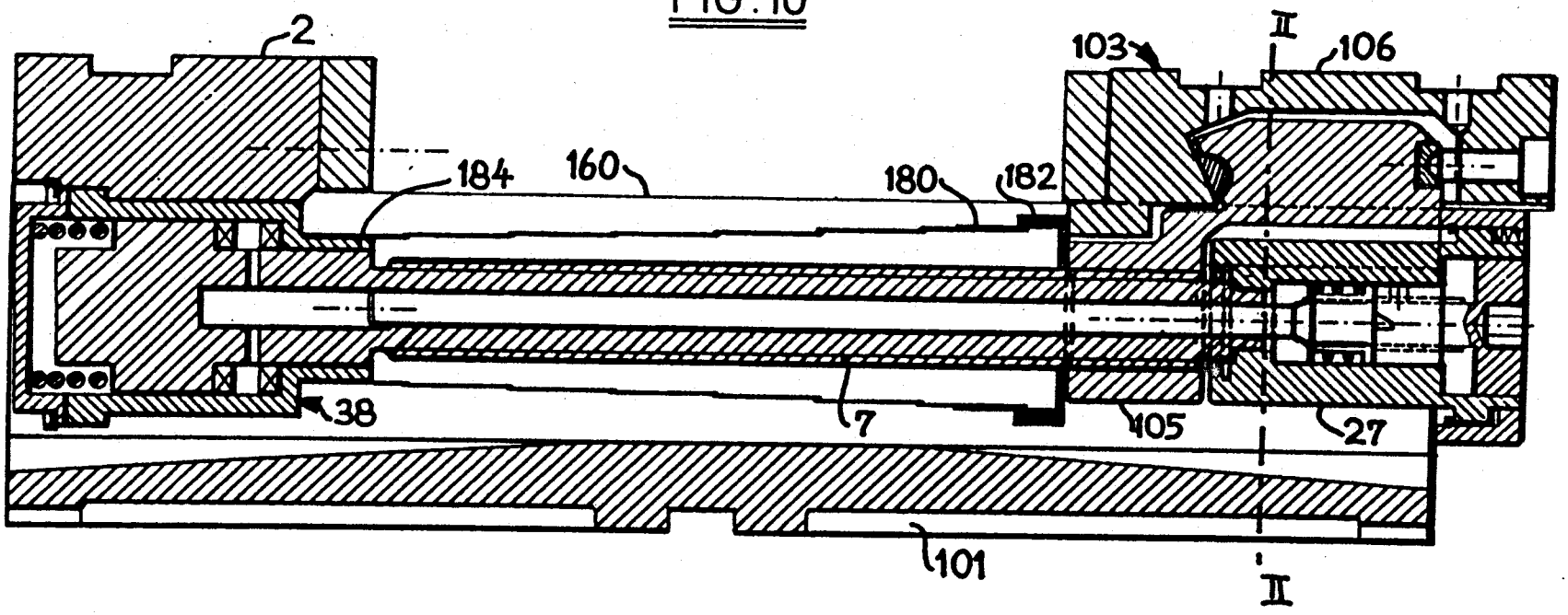
Figure 11:
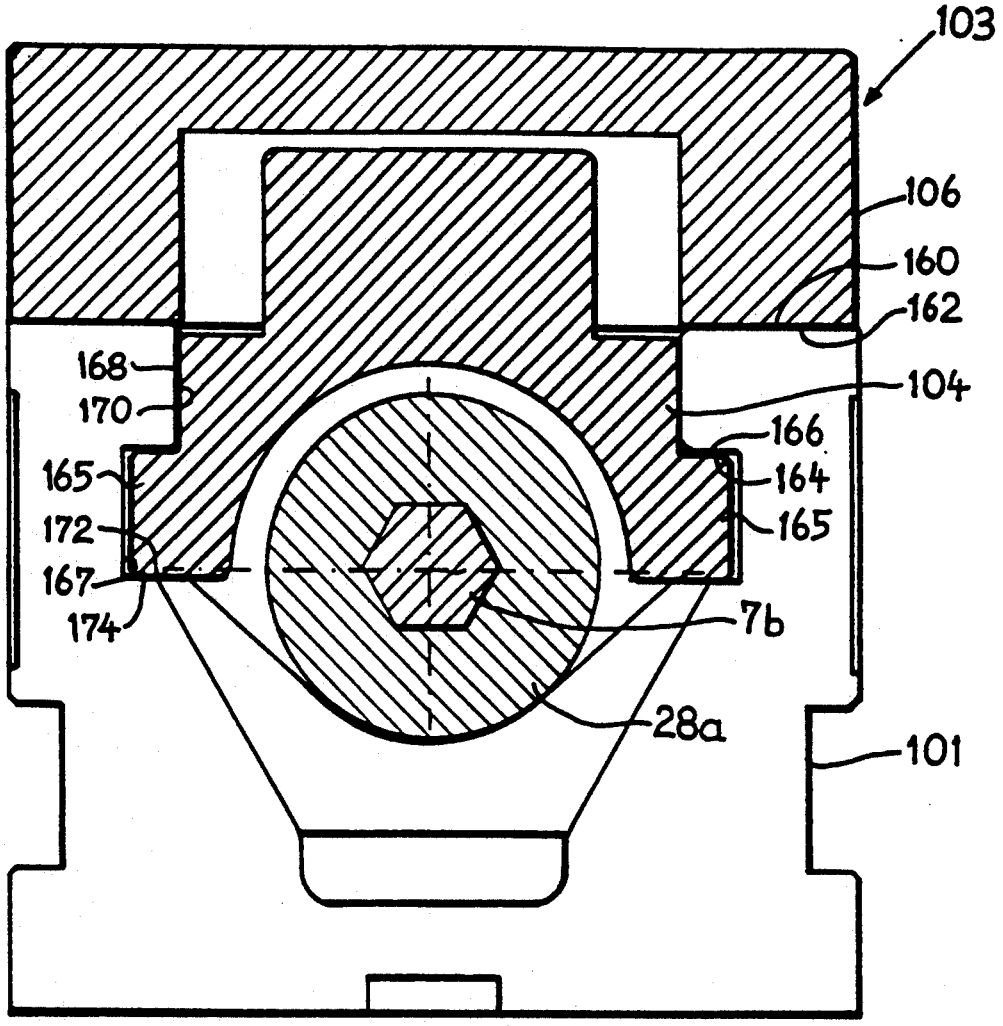
FIG. 11 is a cross sectional view of the machine vise of FIG. 10 along the line XI—XI.

FIGS. 9 to 16 illustrate embodiments including a further improvement of the machine vise of the invention. Specifically, the machine vise of these embodiments uses a split movable jaw 103. FIGS. 9 and 10 relate to an embodiment comprising a hydraulic force amplifier 38 according to FIG. 6 and a driving device 27 according to FIG. 3. Similar elements are designated with similar reference numbers. As regards the design and function thereof it is referred to the description given above.

Therefore, the following description relates to modifications only made for the embodiments already explained before.

First, it is referred to FIGS. 9, 10, and 10, showing movable jaw 103 designed in accordance with the invention.

Specifically, movable jaw 103 is split into a lower jaw part 104 integrally provided with a relatively short spindle nut 105 and an insert portion 112 and loosely received in recess 110 of an upper jaw part 106 of movable jaw 103. Lower jaw part 104 is formed as a slide moving in axial direction of body 101 taking along upper jaw part 106. It should be noted that lower jaw part 104 is considerably longer than spindle nut 105 having a dome-type design above screw spindle 7 enabling withdrawal of upper jaw part 106 in a position just above driving device 27 with the advantage of a strict guidance along its total length.

Particular attention is drawn to various opposing surfaces of the upper and lower jaw parts 106, 104 and in particular opposing surfaces 114, 116 extending inclined in respect of the longitudinal axis of screw spindle 7 (FIG. 15) between about 55° and 75°, preferably about 65° and 70° as well as surface 118, 120, and 122, 124 extending essentially in axial direction, i.e. parallel to screw spindle 7 with the latter surfaces being closer to the longitudinal axis of screw spindle 7 than surfaces 118, 120.

Insert portion 112 has considerable loose in radial and in particular in axial directions. The loose in axial direction is elastically limited by spring means, exemplary in form of a spring washer package 136 inserted into a recess 134 provided in an end surface of insert portion 112 opposing surface 116. Threaded pin 132 urging against spring washer package 136 is passed through a threaded bore 130 extending in the direction of the longitudinal axis of screw spindle 7 in upper jaw part 106 from the exterior end surface thereof for adjusting the spring force.

Recesses 140 in upper jaw part 106 permit inserting of additional jaws in well-known manner.

As will be explained hereinafter, the design of the engagement between surfaces 114, 116 of the upper and lower jaw part 106, 104 are of importance for the invention and several solutions are explained below.

Figure 15:
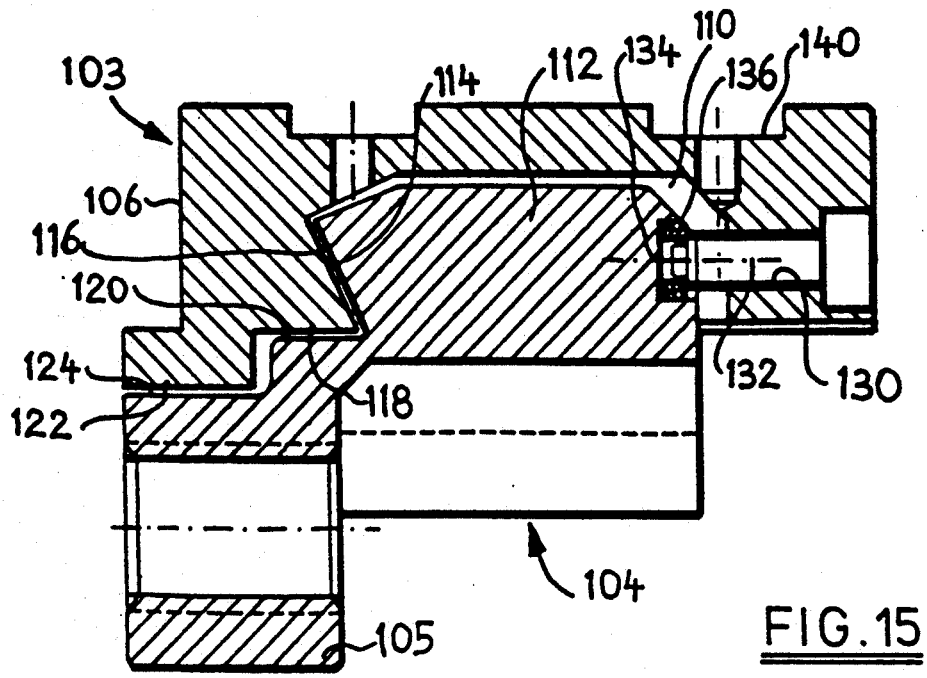

Thus, FIG. 15 illustrates the simplest design where the two surfaces 114, 116 are just machined and engage each other in clamping condition. As a modification, one or the two surfaces may be curved, preferably cylindrically, resulting in a line contact between the two surfaces. This would reduce friction. However, rather high area pressures must be expected necessitating rather hard materials and an exact manufacturing.

Figure 12:
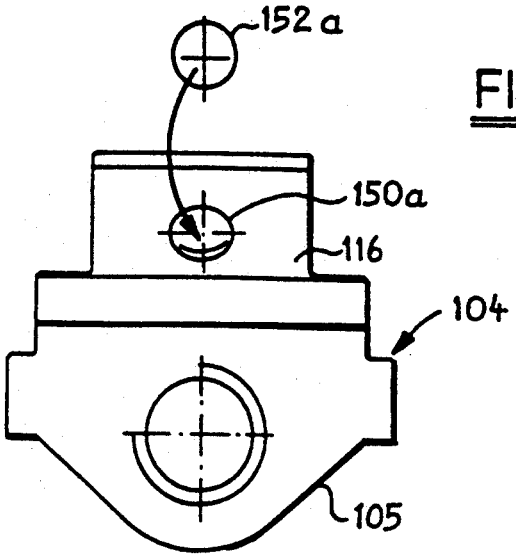
FIGS. 12 and 13 are end views onto two alternative embodiments of a lower jaw part of the movable jaw used with the embodiment according to FIG. 9.
Figure 13:
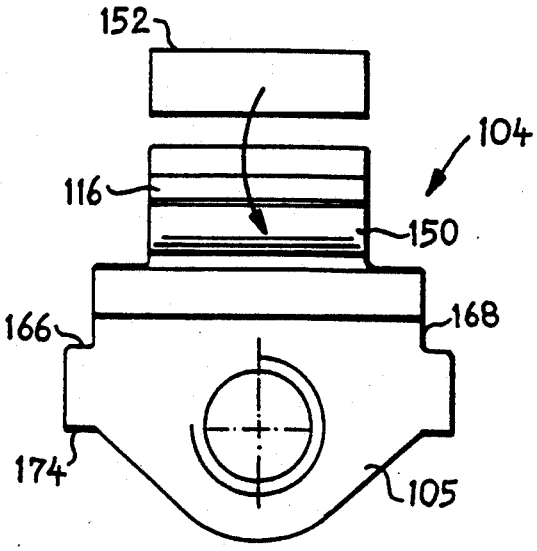
Figure 14:
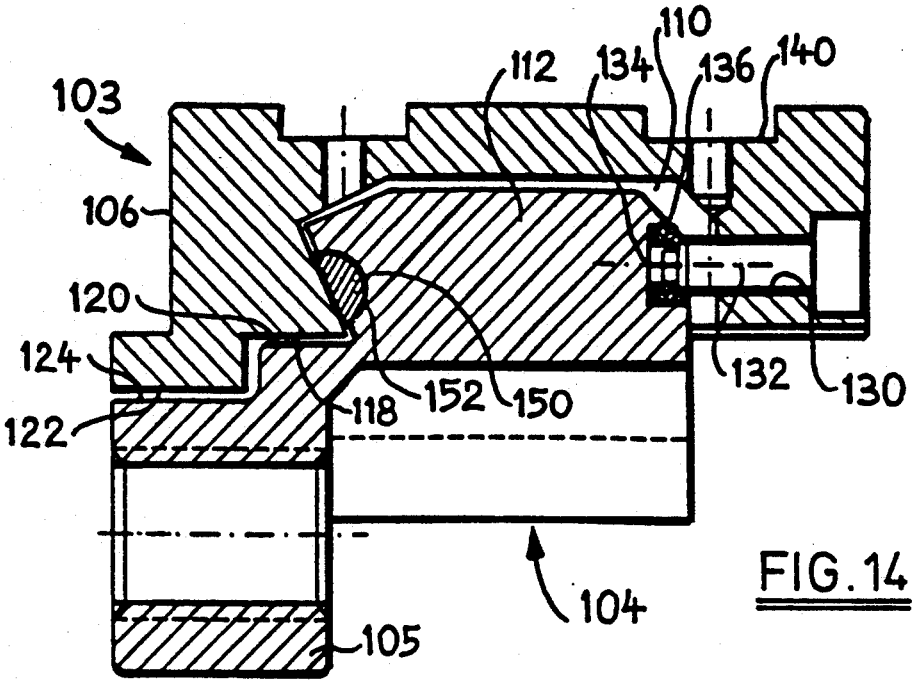
FIGS. 14 and 15 are longitudinal sectional views of two alternative embodiments of movable jaws.

FIGS. 12, 13, and 14 illustrate modifications where in surface 114 of insert portion 112 a recess 150 is formed into which, slightly projecting beyond surface 114, an insert body 152, preferably made of hardened steel, may be inserted. Opposing surface 116 is just machined. As specifically indicated in FIGS. 12 and 13, recess 150 and consequently insert body 152 may have the form of a bar having semicircular cross section (FIG. 13) or may have the form of a hemisphere 152*a* inserted in a complementary recess 150*a* (FIG. 12). In clamping condition there is a surface-type engagement of surface 114 with plane surface of insert body 152 or 152*a*, respectively.

A third alternative would be a spheric insert body in recess 150*a* in FIG. 12; however, this would again result in an extremely high area pressure in view of the punctual engagement in clamping condition.

Due to the insert body being movable lateral angular errors in guiding the upper and lower jaw parts are compensated.

It should be noted that an important feature of the embodiments having a split movable jaw 103 is the improved guidance of movable jaw 103 in body 101, as may be particularly gathered from FIG. 10.

As with the machine vise according to the embodiments of FIGS. 1 to 8 guidance of movable jaw 103 is on a surface 160 extending horizontally along the upper side of body 101 supporting upper jaw part 106 at a lower horizontal surface 162 thereof.

For lateral guidance lower jaw part 104 and body 101 are provided with engaging vertical side surfaces 168, 170. Additional horizontal guidance is established according to the invention between longitudinal key ledges 165 laterally projecting at the lower side of lower jaw part 104 and having essentially rectangular shape, and guiding grooves or slots 167 formed in body 101 and guided horizontally at the upper and lower surfaces, respectively, by engagement of lower surfaces 172, 174 and upper surfaces 164, 166.

For clamping a workpiece the crank (not shown) is turned and slide 104 of the lower jaw part moves toward the workpiece due to the threading of screw spindle 7. Via the inclined surfaces 114, 116 between slide 104 and upper jaw part 106, upper jaw part 106 is taken along moving on guiding surfaces 160 toward the workpiece.

By means of the resilient elements, i.e. the spring washer package 136, there is a biasing force urging even prior to clamping upper jaw part 106 in surface engagement against guiding path 160. This essentially removes the loose between upper jaw part 106 and guiding path 160.

Lower jaw part 104 is guided within upper and lower guidances 164/166 and 172/174, respectively, within body 101. Since the exactness of guidance is determined by the ground surfaces of the guiding path 160 and bottom side 162 of the upper jaw part 106, guidances 164/166 and 172/174 within body 101 need not be ground.

The rectangular alignment of the arrangement is determined by having ground vertical end edges of guidance paths 168/170 of slide 104 and body 101, respectively.

Upon engagement of upper jaw part 106 with the workpiece coupling 32, 33, 34 (FIG. 1) of screw spindle 7 is decoupled whilst force amplifier 38 is actuated via pushing rod 18. Force amplifier 38 abuts against a head portion of body 101 pulling screw spindle 7 in clamping direction. This abutment avoids deformation of the head portion of body 101. Furthermore, body 101 is essentially kept free from any tensions.

Moving jaw 103 is pulled into clamping position via the threading of screw spindle 7. Due to inclined contact surfaces 114/116 a horizontal force component clamps the workpiece. Furthermore, there is a vertical component depending on the angle of surfaces 114/116 in respect of the longitudinal axis of screw spindle 7 selected such that upper jaw part 106 is pressed downward along its total length. However, since by spring washer package 136 upper jaw part 106 is clamped against guiding paths 160 there is only a horizontal clamping movement toward the workpiece but no movement upward or downward, i.e. there is no tilting of upper jaw part 106 which might move the workpiece.

It should be noted that with known types of spindle arrangements there must be a certain loose for a vertical movement of the movable jaw 103. However, with the machine vise according to the invention only the lower jaw part 104 moves without any influence onto upper jaw part 106 and the workpiece clamped thereby.

With known machine vises, for instance according to U.S. Pat. 3,416,784, spring means are used for biasing the movable jaw. However, these spring means urge the movable jaw upward prior to clamping. Therefore, this movable jaw is moved downward during clamping. This disadvantage is avoided with the invention since the spring washer package 136 does just the contrary.

In view of the clamping force applied the guided slide-type lower jaw part 104 will only slightly tilt until the lower outer edge thereof abuts against the lower guidance 172 in body 101 and the upper inner edge abuts against the upper surface of guidance 164.

Due to this arrangement upper jaw part 106 is not moved at all and only lower jaw part 104 is tilted. However, this has no influence onto the workpiece.

It should be noted that with other known machine vises, for instance according to U.S. Pat. No. 4,098,500, the angle of the inclined surface 114/116 is selected with about 45° resulting in high frictional losses. With the machine vise according to the invention it is possible, due to the specific guidance for slide 104, to keep the angle in respect to the longitudinal axis of the screw spindle 7 in the order of 55° to 70°, preferably 65° to 70° resulting in a considerable reduction of friction.

As mentioned before, the specific split design of movable jaw 103 and its particular arrangement within the machine vise according to the invention may be applied with advantage for various configurations of machine vises not restricted to the embodiments according to FIGS. 1 to 8. Thus, the specific split movable jaw 103 of the invention may be used as well for a machine vise using a pressing rather than a tractive screw spindle 7. Furthermore, force amplifiers as 8 or 38 may be arranged below the fully retracted movable jaw in distinction to the arrangement of the force amplifier with the embodiments according to FIGS. 1 to 8, where the force amplifier is arranged below stationary jaw 2.

Figure 16:
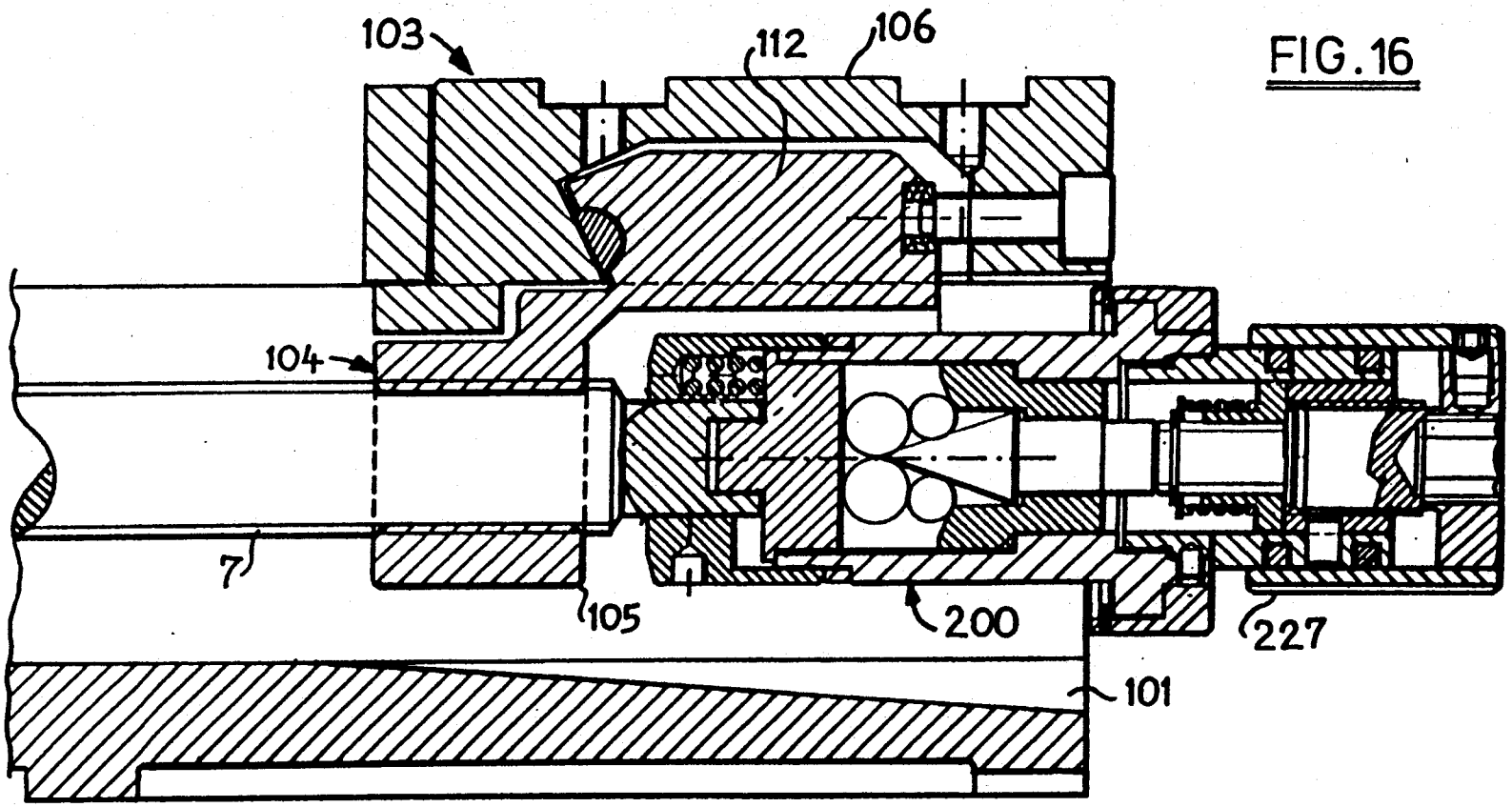
FIG. 16 is a longitudinal sectional view of a machine vise according to a sixth embodiment of the invention with a force amplifier located below the movable jaw in its fully retracted position.

As an example for such an arrangement it is referred to FIG. 16 just schematically showing a force amplifier 200 activated by a driving device 227 and arranged below the movable jaw 103 in its retracted position (see German Laid Open Publication DE 34 37 403 A 1).

FIGS. 9 and 10 illustrate a further inventive improvement of a machine vise generally applicable. Screw spindle 7 is enclosed in a cover 180 for protection thereof against dirt. Cover 180 is flexible in longitudinal direction. It may be implemented as bellow. With the embodiment cover 180 is implemented as a telescopetpye device in the form of either a wound helical leaf spring or of a plurality of cylindrical tube-like portions.

Cover 180 may be fixed at its one end on a tube-type end 184 of force amplifier 38 and at its other end by means of a fixing device 182 at the end face of spindle nut 105.

We claim:

1. A machine vise for clamping a workpiece, comprising:

an elongated body having a lengthwise extending recess of generally U-shaped cross section;

a fixed jaw provided at one end of said body;

a movable jaw arranged for sliding on guiding surfaces in an axial direction along sad body toward said fixed jaw and having formed thereon a projection extending into said recess and having a nut formed therein;

moving means for said movable jaw arranged in said recess and extending in said axial direction thereof and including a hollow screw spindle engaging said nut and having arranged therein a pushing rod;

a force amplifier means arranged in said body below said fixed jaw and operable by said pushing rod;

driving means common to said screw spindle and said force amplifier means and acting against an end of said pushing rod opposite to said force amplifier for first moving said movable jaw into a preliminary clamping position by rotating said screw spindle and then activating said force amplifier means upon exceeding a predetermined clamping force, said driving means being arranged within said body below said movable jaw when in a fully retracted position; and connecting means arranged slidably in said axial direction and connecting an end of said screw spindle adjacent to said force amplifier and an end of said force amplifier opposite to said pushing rod for connecting said fixed jaw, wherein said force amplifier means is a mechanical means comprising a primary member and a secondary member both movable in said axial direction and supporting on abutment means fixedly arranged in said body between said force amplifier means and said end of said screw spindle adjacent to said force amplifier means, and wherein said common driving means comprises a threaded sleeve arranged within said body and connected to an end of said screw spindle opposite to said force amplifier means in a manner secured against rotation, but slidably in said axial direction, a driving spindle screwed through said threaded sleeve, rotatable for first moving said movable jaw into said clamping position and acting upon said adjacent end of said pushing rod, and a coupling means arranged between said driving spindle and said threaded sleeve and being decoupled upon exceeding of a predetermined clamping force for activating said force amplifier means through said pushing rod upon further rotation of said driving spindle, said connecting means being arranged around said force amplifier means and passed through said abutment means and being connected to said adjacent end of said screw spindle in an axially fixed but rotatable manner.

2. The machine vise of claim 1, wherein: said connecting means comprises a tracting sleeve arranged slidable in said axial dirction concentrically within said abutment member and surrounding said force amplifier means and suporting said secondary member of said force amplifier means and being provided with at least two axially directed ledges passing through axial recesses of said abutment member and being provided at ends thereof with radailly inward projecting claws engaging a flange provided at said adjacent end of said screw spindle, further comprising a threaded cover closing said tracting sleeve and supporting said secondary member.

3. A machine vise for clamping a workpiece, comprising:

an elongated body having a lengthwise extending recess of generally U-shaped cross section;

a fixed jaw provided at one end of said body;

a movable jaw arranged for sliding on guiding surfaces in an axial direction along said body toward said fixed jaw and having formed thereon a projection extending into said recess and having a nut formed therein;

moving means for said movable jaw arranged in said recess and extending in said axial direction thereof and including a hollow screw spindle engaging said nut and having arranged therein a pushing rod;

a force amplifier means arranged in said body below said fixed jaw and operable by said pushing rod;

driving means common to said screw spindle and said force amplifier means and acting against an end of said pushing rod opposite to said force amplifier for first moving said movable jaw into a preliminary clamping position by rotating said screw spindle and then activating said force amplifier means upon exceeding a predetermined clamping force, said driving means being arranged within said body below said movable jaw when in a fully retracted position; and connecting means arranged slidably in said axial direction and connecting an end of said screw spindle adjacent to said force amplifier and an end of said force amplifier opposite to said pushing rod for connecting said fixed jaw, wherein said abutment means comprises an abutment sleeve inserted into a cylindrical through-passage in said body and being provided at an end thereof distant from said screw spindle with a flange engaging an annular stop surface of said fixed jaw provided at an end of said through-passage distant from said screw spindle.

4. The machine vise of claim 3, wherein:

said abutment means comprises an abutment sleeve inserted into a cylindrical through-passage in said body and being provided at an end thereof distant from said screw spindle with a flange engaging an annular stop surface of said fixed jaw provided at an end of said through-passage distant from said screw spindle, further comprising a pot-type cover closing said end of said abutment sleeve distant from said screw spindle and a compression spring provided between said dover and an end surface of said secondary member.

5. A machine vise for clamping a workpiece, comprising:

an elongated body having a lengthwise extending recess of generally U-shaped cross section;

a fixed jaw provided at one end of said body;

a movable jaw arranged for sliding on guiding surfaces in an axial direction along said body toward said fixed jaw and having formed thereon a projection extending into said recess and having a nut formed therein;

moving means for said movable jaw arranged in said recess and extending in said axial direction thereof and including a hollow screw spindle engaging said nut and having arranged therein a pushing rod;

a force amplifier means arranged in said body below said fixed jaw and operable by said pushing rod;

driving means common to said screw spindle and said force amplifier means and acting against an end of said pushing rod opposite to said force amplifier for first moving said movable jaw into a preliminary clamping position by rotating said screw spindle and then activating said force amplifier means upon exceeding a predetermined clamping force, said driving means being arranged within said body below said movable jaw when in a fully retracted position; and connecting means arranged slidably in said axial direction and connecting an end of said screw spindle adjacent to said force amplifier and an end of said force amplifier opposite to said pushing rod for connecting said fixed jaw, wherein said force amplifier means is a mechanical means comprising a primary member and a secondary member both movable in said axial direction and supporting on abutment means fixedly arranged in said body between said force amplifier means and said end of said screw spindle adjacent to said force amplifier means, and wherein said connecting means comprises a tracting sleeve arranged to be slidable in said axial direction concentrically within said abutment means and surrounding said force amplifier means and supporting said secondary member of said force amplifier means and being provided with a least two axially directed ledges passing through axial recesses of said abutment member and being provided at ends thereof with radially inward projecting claws engaging a flange provided at said adjacent end of said screw spindle.

6. A machine vise for clamping a workpiece, comprising:

an elongated body having a lengthwise extending recess of generally Y-shaped cross section;

a fixed jaw provided at one end of said body;

a movable jaw arranged for sliding on guiding surfaces in an axial direction along said body toward said fixed jaw and having formed thereon a projection extending into said recess and having a nut formed therein;

moving means for said movable jaw arranged in said recess and extending in said axial direction thereof and including a hollow screw spindle engaging said nut and having arranged therein a pushing rod;

a force amplifier means arranged in said body below said fixed jaw and operable by said pushing rod;

driving means common to said screw spindle and said force amplifier means and acting against an end of said pushing rod opposite to said force amplifier for first moving sand movable jaw into a preliminary clamping position by rotating said screw spindle and then activating said force amplifier means upon exceeding a predetermined clamping force, said driving means being arranged within said body below said movable jaw when in a fully retracted position; and connecting means arranged slidably in said axial direction and connecting an end of said screw spindle adjacent to said force amplifier and an end of said force amplifier opposite to said pushing rod for connecting said fixed jaw, wherein said force amplifier means is a mechanical means comprising a primary member and a secondary member both movable in said axial direction and supported on abutment means fixedly arranged in said body between said force amplifier means and said end of said screw spindle adjacent to said force amplifier means, and said common driving means further comprises a cylindrical housing surrounding said driving spindle, said coupling means, and said threaded sleeve, and having an end of said cylindrical housing connected to said screw spindle in a positive axially shiftable manner, but secured against rotation whilst another end of said cylindrical housing is supported rotatably but is axially non-shiftable in a supporting plate mounted in said body.

7. A machine vise for clamping a workpiece, comprising:

an elongated body having a lengthwise extending recess of generally U-shaped cross section;

a fixed jaw provided at one end of said body;

a movable jaw arranged for sliding on guiding surfaces in an axial direction along said body toward said fixed jaw and having formed thereon a projection extending into said recess and having a nut formed therein;

moving means for said movable jaw arranged in said recess and extending in said axial direction thereof and including a hollow screw spindle engaging said nut and having arranged therein a pushing rod;

a force amplifier means arranged in said body below said fixed jaw and operable by said pushing rod;

driving means common to said screw spindle and said force amplifier means and acting against an end of said pushing rod opposite to said force amplifier for first moving said movable jaw into a preliminary clamping position by rotating said screw spindle and then activating said force amplifier means upon exceeding a predetermined clamping force, said driving means being arranged within said body below said movable jaw when in a fully retracted position; and connecting means arranged slidably in said axial direction and connecting an end of said screw spindle adjacent to said force amplifier and an end of said force amplifier opposite to said pushing rod for connecting said fixed jaw, wherein said force amplifier means is a hydraulic means comprising a primary piston and a secondary piston both movable in said axial direction, said force amplifier means supports on an abutment member arranged in said body said pushing rod acting against said primary piston of said force amplifier means, and said tractively acting connecting means comprises a hollow connecting member concentrically surrounding said primary piston and passing through said abutment member and connecting said second piston to said adjacent end of said screw spindle in an axially fixed connection an inner space of said connecting member being filled with hydraulic fluid through at least one radial bore connecting said inner space with a surrounding cylindrical space of said secondary piston wherein said common driving means comprises a pneumatic cylinder arranged essentially within said body, being connected at one end thereof to said screw spindle in a positive axially manner, but secured against rotation and having an annular peripheral projection supported rotatably but axially non-shiftable in a supporting plate connecting to said body a primary piston being shiftable within said cylinder by means of a plunger a free end of which forming said force amplifier means, and essential portion of said hollow screw spindle forming a cylindrical space filled with hydraulic fluid and having a primary member of said force amplifier means arranged shiftable therein.

* * * * *